US010994959B2

(12) United States Patent
Picchi et al.

(10) Patent No.: US 10,994,959 B2
(45) Date of Patent: May 4, 2021

(54) APPARATUS AND METHOD FOR UNWINDING REELS AND FOR JOINING A PLY BETWEEN TWO REELS

(71) Applicant: GAMBINI S.p.A., Milan (IT)

(72) Inventors: Fabio Picchi, Lammari (IT); Giovanni Buffa, Ponte Buggianese (IT)

(73) Assignee: GAMBINI S.P.A., Milan (IT)

( * ) Notice: Subject to any disclaimer, the term of this patent is extended or adjusted under 35 U.S.C. 154(b) by 197 days.

(21) Appl. No.: 16/268,808

(22) Filed: Feb. 6, 2019

(65) Prior Publication Data

US 2019/0241388 A1 Aug. 8, 2019

(30) Foreign Application Priority Data

Feb. 8, 2018 (IT) ..... 102018000002504

(51) Int. Cl.
*B65H 19/20* (2006.01)
*B65H 19/18* (2006.01)

(52) U.S. Cl.
CPC ..... *B65H 19/1889* (2013.01); *B65H 19/1836* (2013.01); *B65H 19/1873* (2013.01); *B65H 19/20* (2013.01); *B65H 2301/4186* (2013.01); *B65H 2301/4621* (2013.01); *B65H 2301/46022* (2013.01); *B65H 2301/46115* (2013.01); *B65H 2301/46174* (2013.01); *B65H 2403/942* (2013.01); *B65H 2408/216* (2013.01); *B65H 2553/212* (2013.01); *B65H 2701/1924* (2013.01); *B65H 2801/84* (2013.01)

(58) Field of Classification Search
CPC ..... B65H 19/20; B65H 19/1836; B65H 19/1873; B65H 19/1889; B65H 2801/84
See application file for complete search history.

(56) References Cited

U.S. PATENT DOCUMENTS 4,455,190 A * 6/1984 Bianchetto ..... B65H 19/1852 156/504
5,975,457 A * 11/1999 Forbes ..... B65H 19/102 242/552
6,051,095 A 4/2000 Butterworth
(Continued)

FOREIGN PATENT DOCUMENTS

WO 2005108255 A1 11/2005

*Primary Examiner* — Sang K Kim
(74) *Attorney, Agent, or Firm* — Cantor Colburn LLP

(57) ABSTRACT

An apparatus, and a related method, for unwinding reels and for joining a ply between two reels including a first unwinder adapted to unwind a first reel, a second unwinder adapted to unwind a second reel, a joining device adapted to join a first ply belonging to the first reel with a second ply belonging to the second reel, the joining device including a first pulling bar is able to pull a flap of the first ply along a joining path with the second ply, a second pulling bar is adapted to pull a flap of the second ply along a joining path with the first ply, joining means configured to join, in a joining point along the joining path, the flap of the first ply with the second ply or the flap of the second ply with the first ply, first cutting means configured to cut the first ply or the second ply upstream of the joining point where the joint is performed between the first ply and the second ply, and second cutting means configured to cut the flap of the first ply or the flap of the second ply downstream of the joining point.

12 Claims, 15 Drawing Sheets

(56) References Cited

U.S. PATENT DOCUMENTS

| | | | | |
|---|---|---|---|---|
| 6,440,268 | B1 | 8/2002 | Baggot | |
| 6,451,145 | B1 * | 9/2002 | Forbes | B65H 19/1836 156/157 |
| 2008/0258001 | A1 * | 10/2008 | Gelli | B65H 19/1836 242/552 |
| 2017/0341894 | A1 * | 11/2017 | Muller | B65H 19/102 |

* cited by examiner

1

22
13
42
13
4
13
43
13
32
6
T1
11
60
61
41
45
45
5
51
50
T2
70
71
40
7
G
220
11
11
46

APPARATUS AND METHOD FOR UNWINDING REELS AND FOR JOINING A PLY BETWEEN TWO REELS

CROSS REFERENCE TO RELATED APPLICATION

This application is related to and claims the benefit of Italian Patent Application Number 102018000002504 filed on Feb. 8, 2018, the entire contents of which are herein incorporated by reference.

TECHNICAL FIELD

The present disclosure relates to an apparatus for unwinding reels and for joining a ply between two reels, and to the related unwinding and joining method.

BACKGROUND

The present disclosure in general relates to the sector of the transformation of ribbon-like material, such as paper, "tissue' paper and the like, wound in reels, and in particular it relates to the techniques for unwinding the aforesaid reels to feed the ribbon-like material to subsequent processing stations.

Currently, for the production of articles made of so-called "tissue" paper, i.e. toilet paper, paper towels, napkins, handkerchiefs or the like, large-diameter reels are used, obtained by winding one or more plies of paper. These reels are unwound in dedicated unwinders to feed the paper to subsequent processing and transforming stations from which are obtained semi-finished products such as paper rolls known as "logs". From these semi-finished products then, through additional processing and transforming phases, the finished products such as the paper articles listed above are obtained.

When a reel is completely unwound by the unwinder, it must be replaced by a new reel. This replacement operation currently entails interventions to cut the ply of the depleting reel and interventions for connecting it with the initial flap of the new reel, as well as interventions to reposition the new reel in the unwinder.

Currently, there are unwinders that allow to place a new reel in a stand-by position, while the previous reel is finishing being unwound. In this case, the operations for cutting and connecting the two plies of the two reels, generally carried out manually by an operator, can be carried out in a faster manner, because the new reel is already ready to take the position of the depleted reel inside the unwinder.

The reels that are unwound by the aforesaid known unwinders in general have diameters that can change from 1.5 meters to 3 meters. Therefore, for reasons of limiting the bulk of the unwinder itself, it is possible to load a new reel in the stand-by position only when the reel is close to depletion, i.e. it has significantly reduced its diameter. Essentially, known unwinders do not have such dimensions as to be able to house two still new, or otherwise only partially unwound reels.

A drawback that often afflicts known processes for unwinding reels is due to the defects that can be present in the reel itself.

The reel often has paper winding defects, which can consist of ruptures or cuts of the paper, which can also affect the entire width of the ribbon, or in portions of paper that is poorly wound on itself, inside the reel.

These defects can be present in any point of the reel and therefore affect any portion of the longitudinal development of the paper ribbon.

If defects of the reel are present, the procedure for unwinding the reel must necessarily be interrupted, and the operator has to intervene manually to eliminate the section of the paper ribbon that presents the defect and re-join the two flaps of the ribbon, in order to restart the unwinding procedure. Obviously, during the intervention by the operator the unwinder is not active, and this entails interruptions or slow-downs also of the steps of processing and transforming the paper that follow the step of unwinding the reels.

Therefore, although known unwinders allow to replace the depleting reel in a relatively quick manner, above if the replacement operation is at least partially automated, unexpected events due to the winding defects of the paper ribbon of the reel introduce interruptions and critical delays on the paper processing and transformation line.

BRIEF SUMMARY

A main task of the present disclosure is to provide an apparatus and a method for unwinding reels and for joining a ply between two reels that solve the technical problems described above, overcoming the limits of the prior art.

Within this task, a purpose of the present disclosure is providing an apparatus and a method that are able to operate in at least a partially automated manner both on depleting reels and on reels having winding defects of the paper ribbon.

Another purpose of the disclosure is to provide an apparatus and a method that allow to prevent undesired delays and slow-downs in the paper unwinding process.

Another purpose of the present disclosure is to provide an apparatus and a method that make it possible both to join a new reel with a depleting reel, and also to join reels together regardless of the degree of unwinding already attained for at least one of them.

An additional purpose of the disclosure is to provide an apparatus and a method that are able to give the broadest assurance of reliability and safety in use.

Another purpose of the disclosure is to provide an apparatus and a method that are easy to build and implement and economically competitive, compared to the prior art.

BRIEF DESCRIPTION OF THE DRAWINGS

Additional features and advantages will become more apparent from the description of a preferred, but non-exclusive, embodiment of an apparatus for unwinding reels and for joining a ply between two reels, illustrated by way of non-limiting example with the aid of the accompanying drawings, in which.

DETAILED DESCRIPTION

Figure 1:
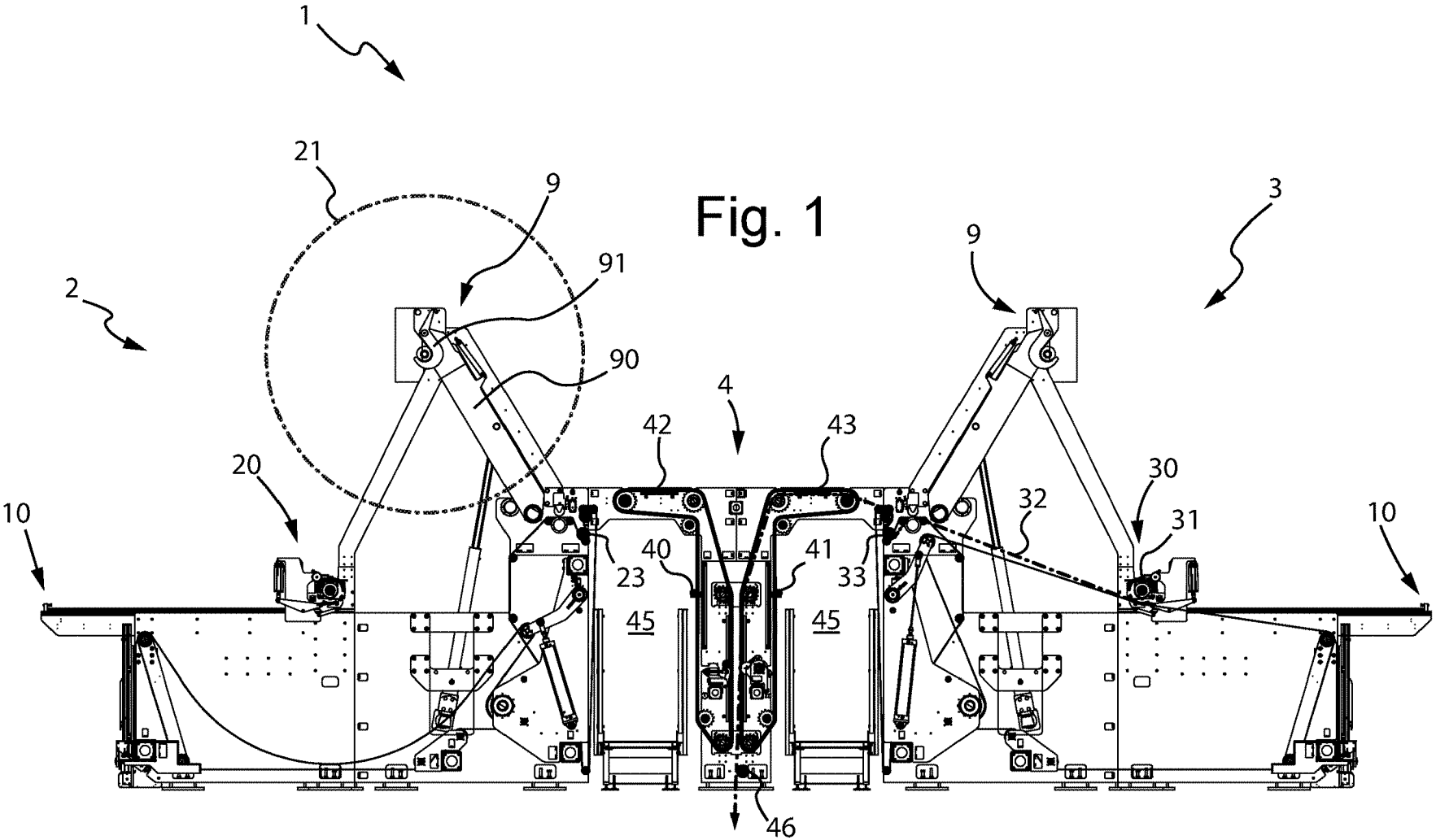
FIG. 1 is a side elevation view of an embodiment of an apparatus for unwinding reels and for joining a ply between two reels, according to the disclosure.

With reference to the aforementioned figures, the apparatus for the unwinding reels and for joining a ply between two reels, is globally designated with the reference number 1.

According to the disclosure, the apparatus 1 comprises a first unwinder 2 adapted to unwind a first reel 21 and a second unwinder 3 adapted to unwind a second reel 31.

The apparatus 1 comprises a joining device 4 adapted to join a first ply 22 belonging to the first reel 21 with a second ply 32 belonging to the second reel 31.

The joining device 4 comprises a pair of pulling bars 40, 41, where a first pulling bar 40 is able to pull a flap of the first ply 22 along a joining path with the second ply 32, while a second pulling bar 41 is adapted to pull a flap of the second ply 32 along a joining path with the first ply 22.

The joining device 4 comprises joining means 5 configured to join, in a joining point along the joining path, the flap of the first ply 22 with the second ply 32 or the flap of the second ply 32 with the first ply 22.

The joining device 4 further comprises first cutting means 6 configured to cut the first ply 22 or the second ply 32 upstream of the joining point where the first ply 22 and the second ply 32 are joined and second cutting means 7 configured to cut the flap of the first ply 22 or the flap of the second ply 32 downstream of said joining point.

In the apparatus 1, an unwinding path of the first reel 21 and an unwinding path of the second reel 31 are defined. The unwinding path of a reel is essentially the path followed by the paper inside the respective unwinder 2, 3.

In the joining device 4 is defined a pulling path of the first pulling bar 40 and a pulling path of the second pulling bar 41. The pulling path of a pulling bar is substantially the path followed by the pulling bar during its movement.

Advantageously, along the aforesaid joining path, the unwinding paths of the reels 21, 31 are respectively facing and parallel to the pulling paths of the pulling bars 40, 41.

As shown in the accompanying figures, the apparatus 1 has an overall structure that is substantially mirror-like with respect to a central plane that cuts the joining device 4 in half.

Advantageously, in the joining point the first pulling bar 40 is able to pull the flap of the first ply 22 along the joining path with the second ply 32 at a pulling speed that is substantially equal to the unwinding speed of the second ply 32.

In the same way, in the joining point the second pulling bar 41 is able to pull the flap of the second ply 32 along the joining path with the first ply 22 at a pulling speed that is substantially equal to the unwinding speed of the first ply 22.

In the joining path, the aforesaid pulling speed and the aforesaid unwinding speed therefore have a common and substantially equal tangential velocity component. This allows to maintain the unwinder 2 or 3, during the joining operations with the flap of the ply present in the opposite unwinder 3 or 2, at a travelling speed above 0 meters per minute, preferably above 20 meters per minute, more preferably above 40 meters per minute, even more preferably approximately 50 meters per minute.

As is better explained further on, having two distinct unwinders 2 and 3 and a joining device 4 shared by the two unwinders 2 and 3 allows to join the flap of the ply of a new reel with the flap of an unwinding reel, in any portion of the ply of the unwinding reel, without interrupting the unwinding, while the new reel is already ready to be unwound and take the place of the other.

Advantageously then it is possible to join the ply of an unwinding reel with the flap of the ply of a new reel in any phase of the unwinding of the unwinding reel, for example because this reel has defects in a portion thereof. The new reel will continue to be unwound to feed the subsequent processing and transformation stations taking the place of the previous reel. In the meantime the operator can intervene on the previous reel, for example to remove its defective part. This reel, with the defects removed, is then ready to be joined, if necessary, with the new reel once it becomes depleted or it presents defects requiring its replacement.

The central symmetry structure of the apparatus 1 advantageously makes it possible to use alternatively the first unwinder 2 or the second unwinder 3.

Advantageously the joining device 4 comprises at least a first pulling chain 42 able to pull the first pulling bar 40 at least along the aforesaid joining path, and at least a second pulling chain 43 able to pull the second pulling bar 41 at least along the aforesaid joining path.

In this case the turn taken by the pulling chains 42, 43 defines the pulling paths of the pulling bars 40, 41, at least a portion of which runs along the aforesaid joining path.

Figure 8:
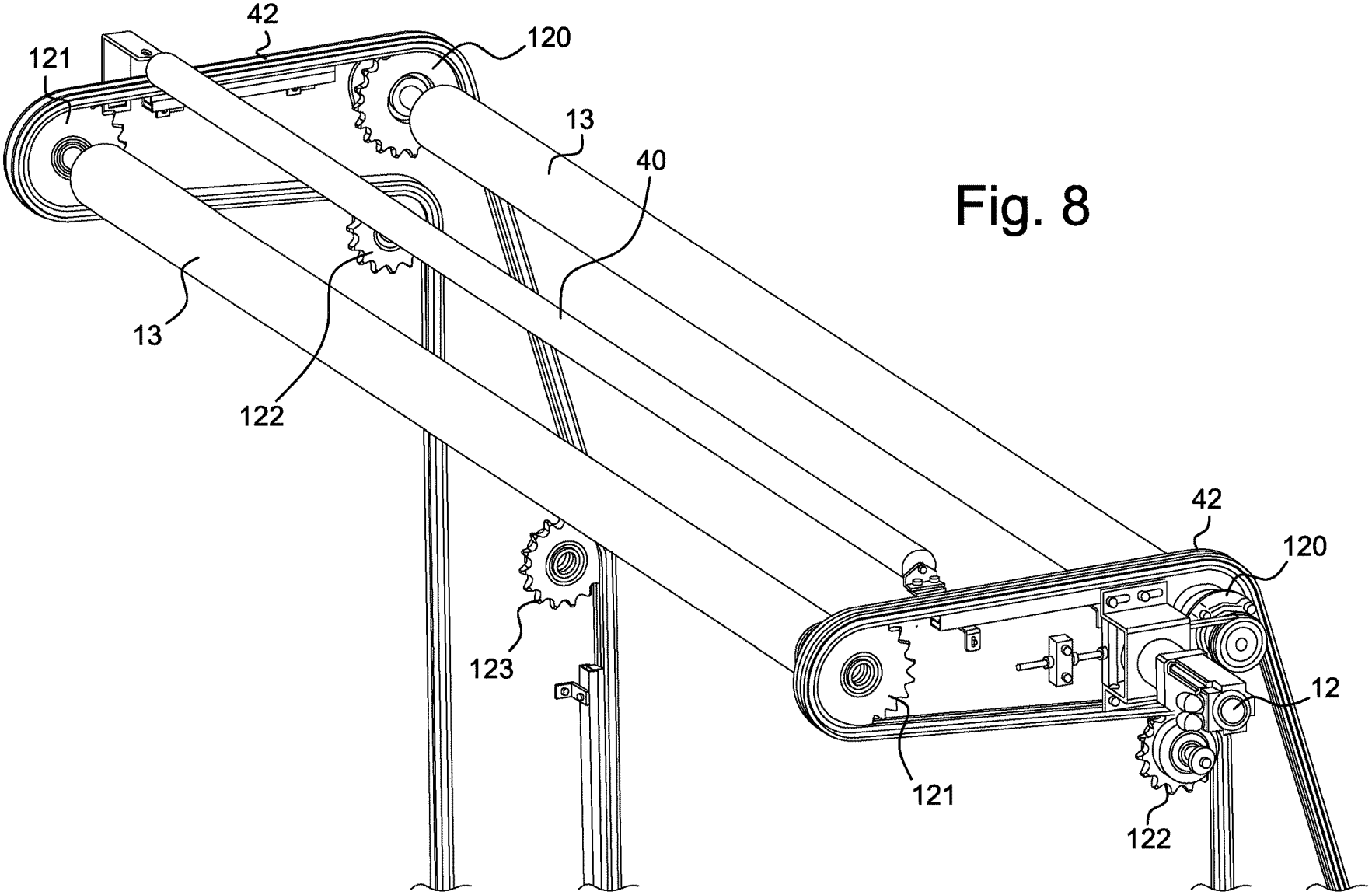
FIG. 8 is a perspective view of an upper portion of a part of the joining device with which the apparatus of FIG. 1 is provided.
Figure 9:
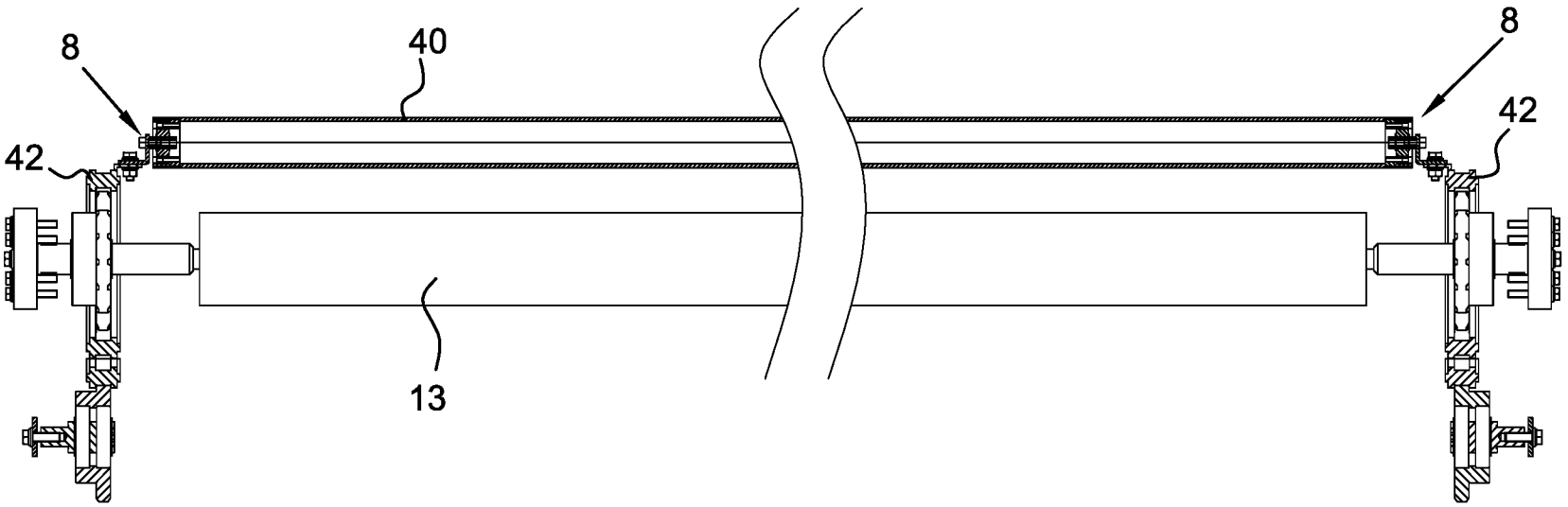
FIG. 9 is a longitudinal section view of a pulling bar of the joining device shown in FIG. 8.

As shown in FIGS. 8 and 9, two pairs of pulling chains 42, 43 can be provided, positioned at the opposite sides of the joining device 4, or at the opposite sides of the pulling bars 40, 41.

Advantageously, the pulling chains 42, 43 define a closed loop, and hence a closed pulling path of the bars 40, 41.

Advantageously, the first unwinder 2 and the second unwinder 3 comprise respectively a first idle return roller 23 for the first ply 22 of the first reel 21 and a second idle return roller 33 for the second ply 32 of the second reel 31. The first idle return roller 23 and the second idle return roller 33 comprise sensors able to sense the state of tension respectively of the first ply 22 and of the second ply 32, for example load cells.

Advantageously the first pulling bar 40 and the second pulling bar 41 are able to rotate around their own axis in a single direction of rotation.

Advantageously the first pulling bar 40 and the second pulling bar 41 are associated respectively with the first pulling chain 42 and the second pulling chain 43 by means of a free wheel mechanism 8.

In this way the flap of the ply of a reel can be associated with the respective pulling bar 40, 41 by winding around it. The fact that the pulling bar 40, 41 can rotate only in one direction makes it possible to prevent the accidental unwinding of the flap of the ply wound around said pulling bar 40, 41.

Advantageously the fixing of the flap of the ply to the related pulling bar 40, 41 comprises trimming the ply, by folding or cutting the flap, so that an operator O can grip the vertex of the trimmed flap around the pulling bar 40, 41 until the ply is wound around the bar through its entire width.

In a preferred embodiment of the apparatus 1, the joining means 5 comprise at least one knurling wheel 50 opposite at least one rigid counter-roller 51. Preferably there is a set of knurling wheels 50 aligned to a corresponding set of rigid counter-rollers 51.

The knurling wheel 50 and the rigid counter-roller 51 are positioned so as to be able to join both the flap of the first ply 22 of the first reel 21 with the second flap 32 of the second reel 31, and the flap of the second ply 32 of the second reel 31 with the first ply 22 of the first reel 21.

To sum up, the same knurling wheel 50, with the related rigid counter-roller 51, is able to join a flap of a ply of a reel with a portion of a ply of another reel, and vice versa.

Advantageously, the first unwinder 2 comprises a first unwinding station 20 where the first reel 21 is unwound, while the second unwinder 3 comprises a second unwinding station 30 where the second reel 31 is unwound.

Advantageously, each of the unwinders 2 and 3 comprises a loading station 9 where it is possible to load a reel 21, 31 that has to be carried into the unwinding station 20, 30.

The loading of a new reel in the loading station 9 does not require interrupting the unwinding of the reel.

Advantageously, the unwinders 2 and 3 can also comprise a stand-by station 10 where a stand-by reel can be placed to take the place of the unwinding reel. Advantageously, the ply of the unwinding reel in the unwinding station 20, 30 can also be joined with the ply of the stand-by reel in the stand-by station 10, stationarily, as takes place in known unwinders.

The first cutting means 6 advantageously comprise a first blade 60 adapted to cut the first ply 22, and a second blade 61, adapted to cut the second ply 32.

The second cutting means 7 advantageously comprise a first blade 70 adapted to cut the flap of the first ply 22, and a second blade 71, able to cut the flap of the second ply 32.

Advantageously, the aforesaid blades 60, 61, 70, 71 are associated with rotatable rollers 11 that can be actuated in rotation so that the blades are brought in contact with the ply 22, 32 or with the flap of the ply 22, 32.

Advantageously, the pulling chains 42, 43 are actuated by an actuator 12, for example electric, provided with a gear wheel 120, and they have a plurality of transmission gear wheels 121, 122, 123, 124, 125.

Advantageously, one or more of said transmission gear wheels 121 have means 126 for tensioning the pulling chains 42, 43.

Advantageously, the aforesaid blades 60, 61, 70, 71 are associated with rotatable rollers 11, coaxial to some of said transmission gear wheels 123.

Advantageously, some return rollers 13 of the unwinders 2 and 3 are also coaxial to some of said transmission gear wheels 120, 121.

Advantageously, the joining device 4 comprises at least one set-up area 45, accessible by an operator O, where the operator can manually associate the flap of the ply of a reel 21, 31 with the pulling bar 40, 41.

Advantageously, a pair of set-up area 45 may be present, to be accessed by an operator O, to associate the flap of the ply of a reel 21, 31 with the respective pulling bar 40, 41.

The present disclosure further relates to a method for unwinding reels and for joining a ply between two reels, comprising the steps of:

- arranging a pair of unwinders 2, 3 configured to unwind a pair of reels 21, 31;
- pulling, at a pulling speed, a flap of a ply 22 of a first reel 21 of said pair of reels 21, 31 along a joining path with a ply 32 of a second reel 31 of said pair of reels 21, 31;
- unwinding, at an unwinding speed, the second reel 31 through an unwinder 3 between said pair of unwinders 2, 3;
- joining the flap of the ply 22 of said first reel 21 with the ply 32 of said second reel 31 in a joining point along said joining path, where, in said joining point, the pulling speed of the ply 22 of said first reel 21 is substantially equal to the unwinding speed of said second reel 31;
- cutting the ply 32 of the second reel 31 upstream of the joining point;
- cutting the flap of the ply 22 of said first reel 21 downstream of said joining point;
- unwinding the first reel 21 through an opposite unwinder 2 between said pair of unwinders 2, 3.

Advantageously, the aforesaid method comprises a setting-up step, in which the flap of the ply 22 of the first reel 21 is associated with a pulling bar 40 configured to pull the flap at least along the joining path with the ply 32 of the second reel 31, and a launching step, in which the aforesaid flap is pulled by the pulling bar 40 towards and beyond the joining point, at the pulling speed.

Advantageously, between the setting-up step and the launching step there is a step of tensioning the ply 22, 32, in which the ply 22, 32 of the first reel 21 or of the second reel 31 associated with the respective pulling bar 40, 41 is tensioned.

An example of operation of the apparatus 1 is explained below, with reference to the apparatus 1 shown in different operating steps in the figures from 1 to 6A.

Figure 1A:
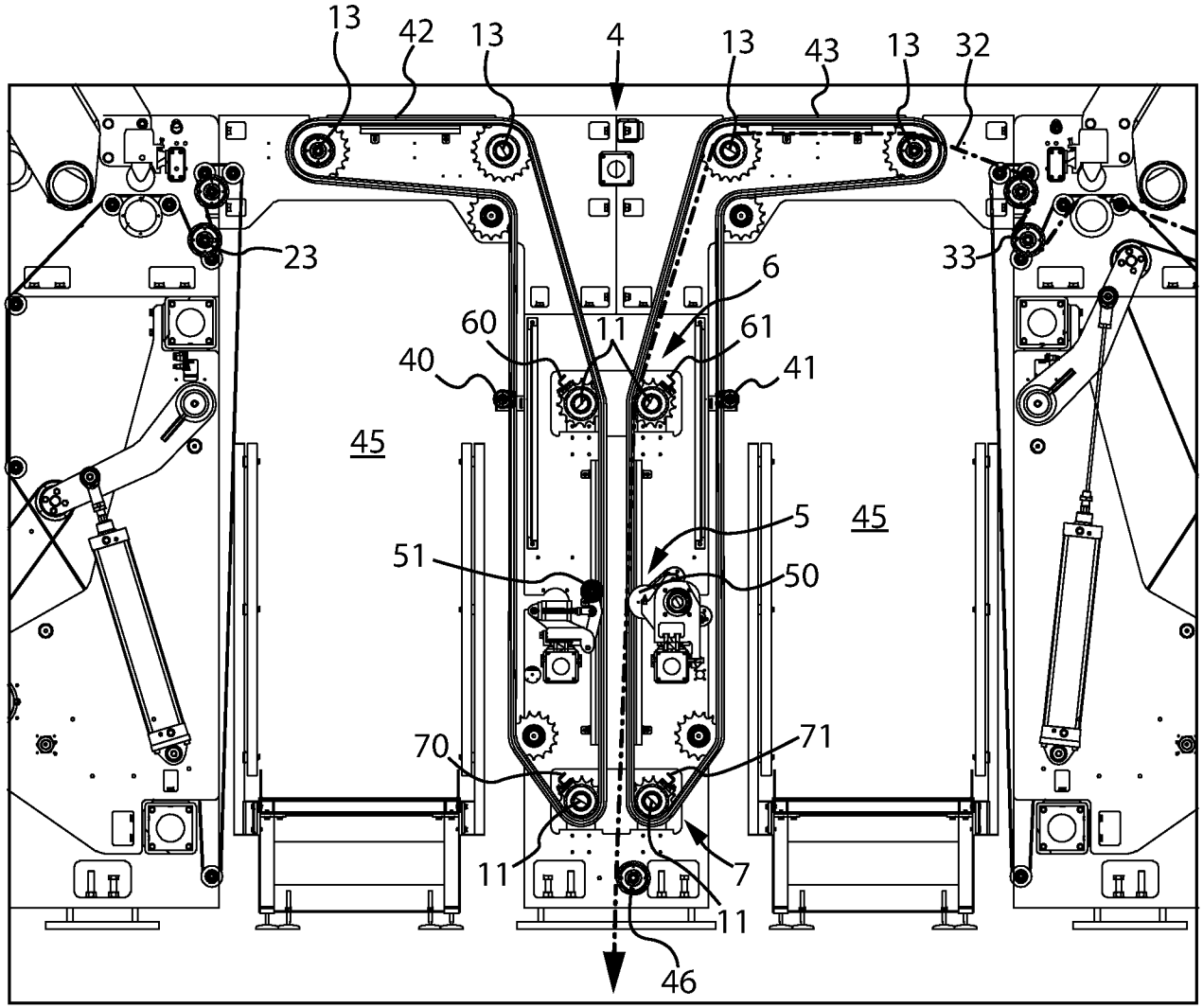
FIG. 1A shows an enlarged portion of the central part of FIG. 1.

In FIGS. 1 and 1A, the second unwinder 3 is unwinding the reel 31, close to depletion. In the meantime a new reel 21 is loaded on the loading station 9 and set up to be placed in the unwinding station 20 inside the unwinder 2.

In particular, the arms 90, having at their ends hooks 91 able to support the new reel 21, are lowered to bring the reel 21 into the unwinding station 20. Once the reel 21 is placed in the unwinding station 20, the arms can return to the high position.

Figure 2:
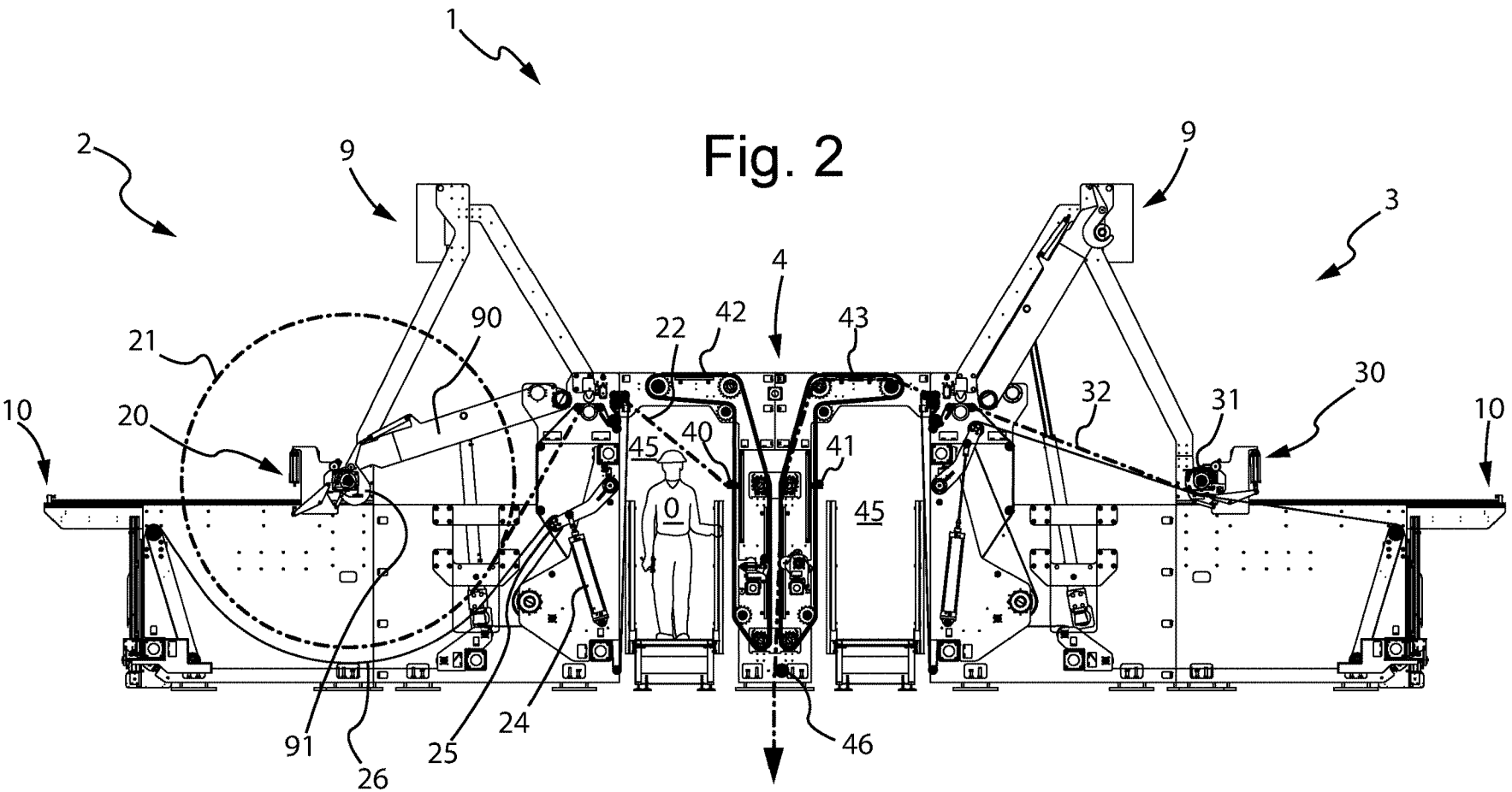
FIGS. 2, 3, 4, 5 and 6 show the apparatus of FIG. 1 in subsequent operating steps.
Figure 2A:
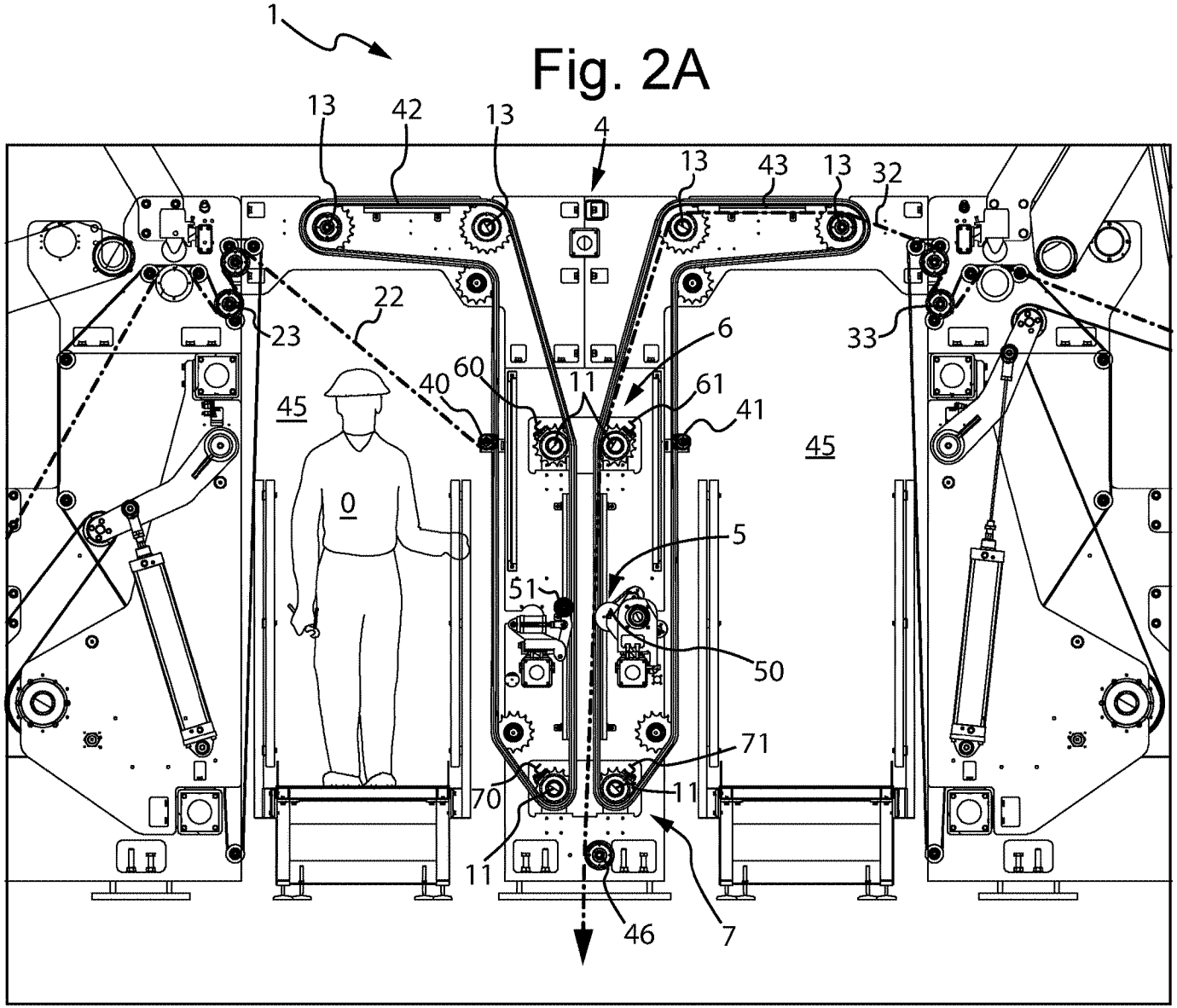
FIGS. 2A, 3A, 4A, 5A, 6A show an enlarged portion of the central part with respect to FIGS. 2, 3, 4, 5 and 6.

In FIGS. 2 and 2A, the new reel 21 is located in the unwinding station 20.

The hooks 91 free the reel 21 and the arms 90 can return to the high position.

An operator O is present inside the set-up area 45. Inside the area 45, the operator O can wind the flap of the ply 22 of the new reel 21 around the first pulling bar 40. In particular, the operator O can take the paper of the reel 21 and start the rotation of the reel by means of a pushbutton panel so as to bring the paper flap to the pulling bar 40. Once the operator O has a sufficient length of paper available, (s)he can trim its end and wind it around the pulling bar 40.

As shown in the accompanying figures, the piston 24 is actuated to raise the lever arm 25 with which the drive belt 26 of the reel 21 is associated. In this way, the drive belt 26 is brought in contact with the reel 21 to actuate its unwinding.

In the meantime, the old reel 31 continues to be unwound by the unwinder 3.

The joining device 4 comprise a terminal return roller 46, from which the flap 22 or 32 is driven towards the subsequent processing or transformation stations.

Figure 3:
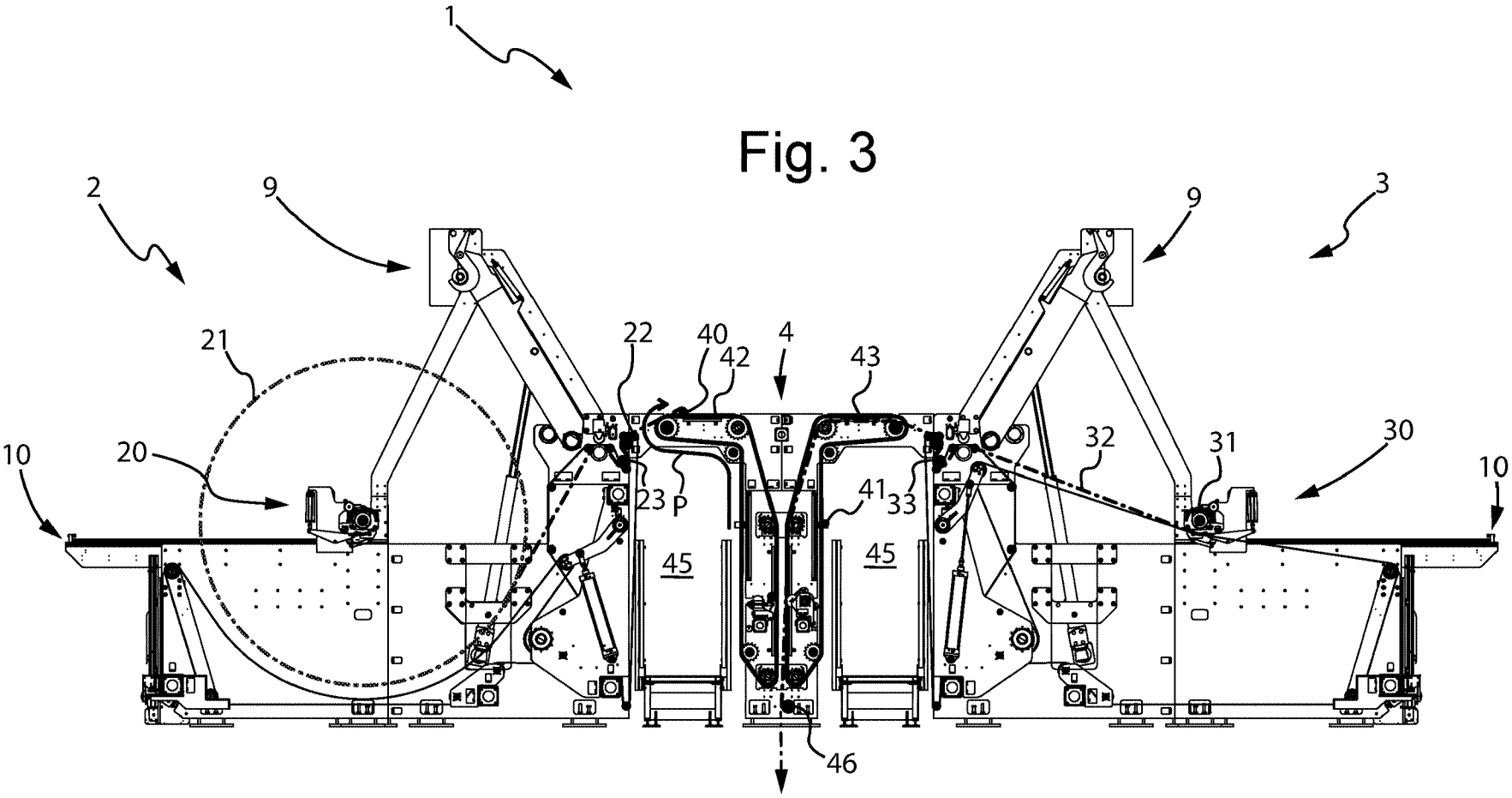
Figure 3A:
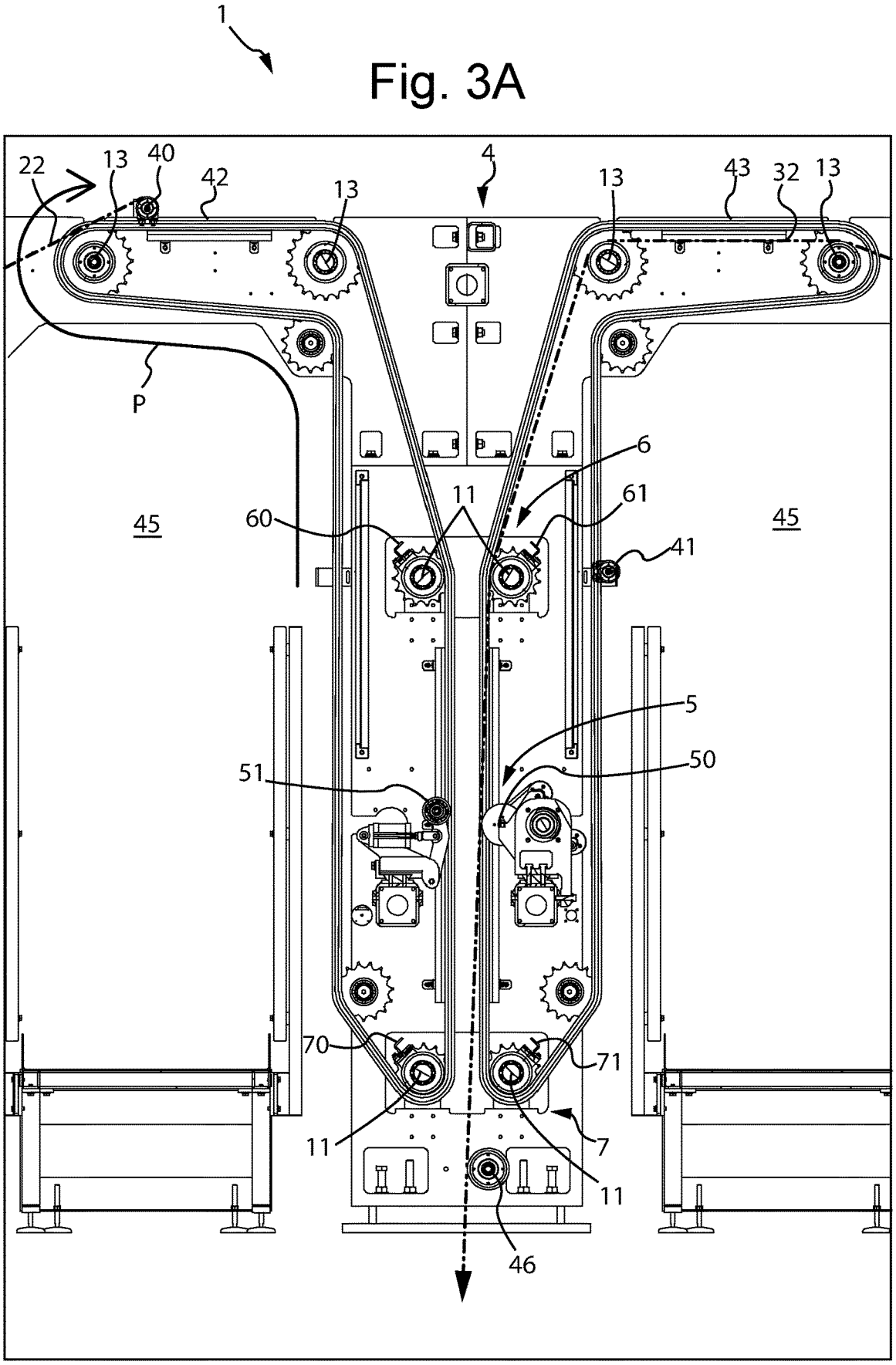

FIGS. 3 and 3A show the step in which the pulling bar 40 is brought to a launch position, and it is ready for the launching step.

The movement of the pulling bar 40, between the setting-up step and the launching step, is indicated by the arrow P.

During the movement of the pulling bar 40 between the setting-up position, in the area 45, and the launching position, the flap 22 tends to loosen and hence must be tensioned again, before launching it towards the joining point.

This paper re-tensioning step can be carried out manually, or automatically, making the reel 21 rotate in the opposite direction to the unwinding direction, on the basis of the degree of tension measured by the tension sensors, such as load cells, present in the sensorized idle return roller 23.

Figure 4:
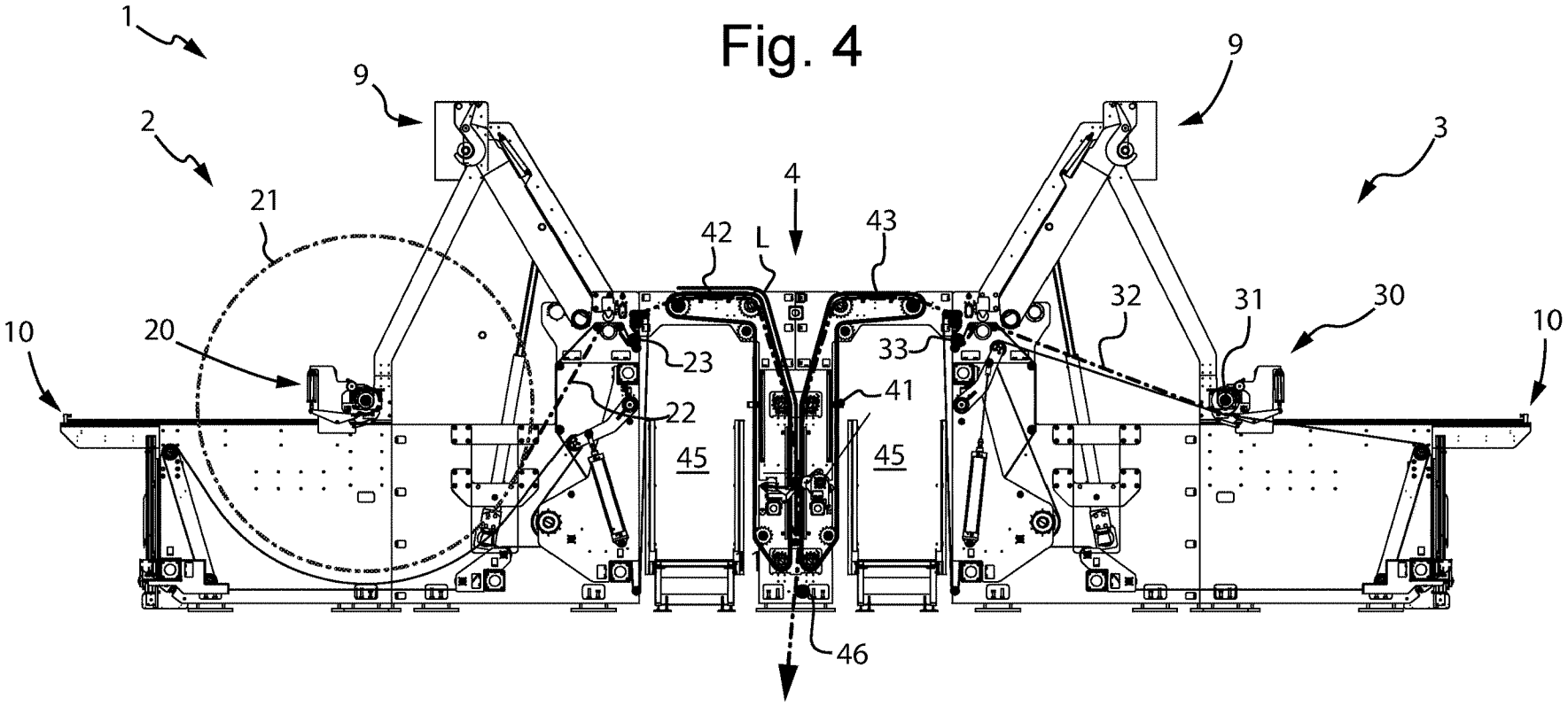
Figure 4A:
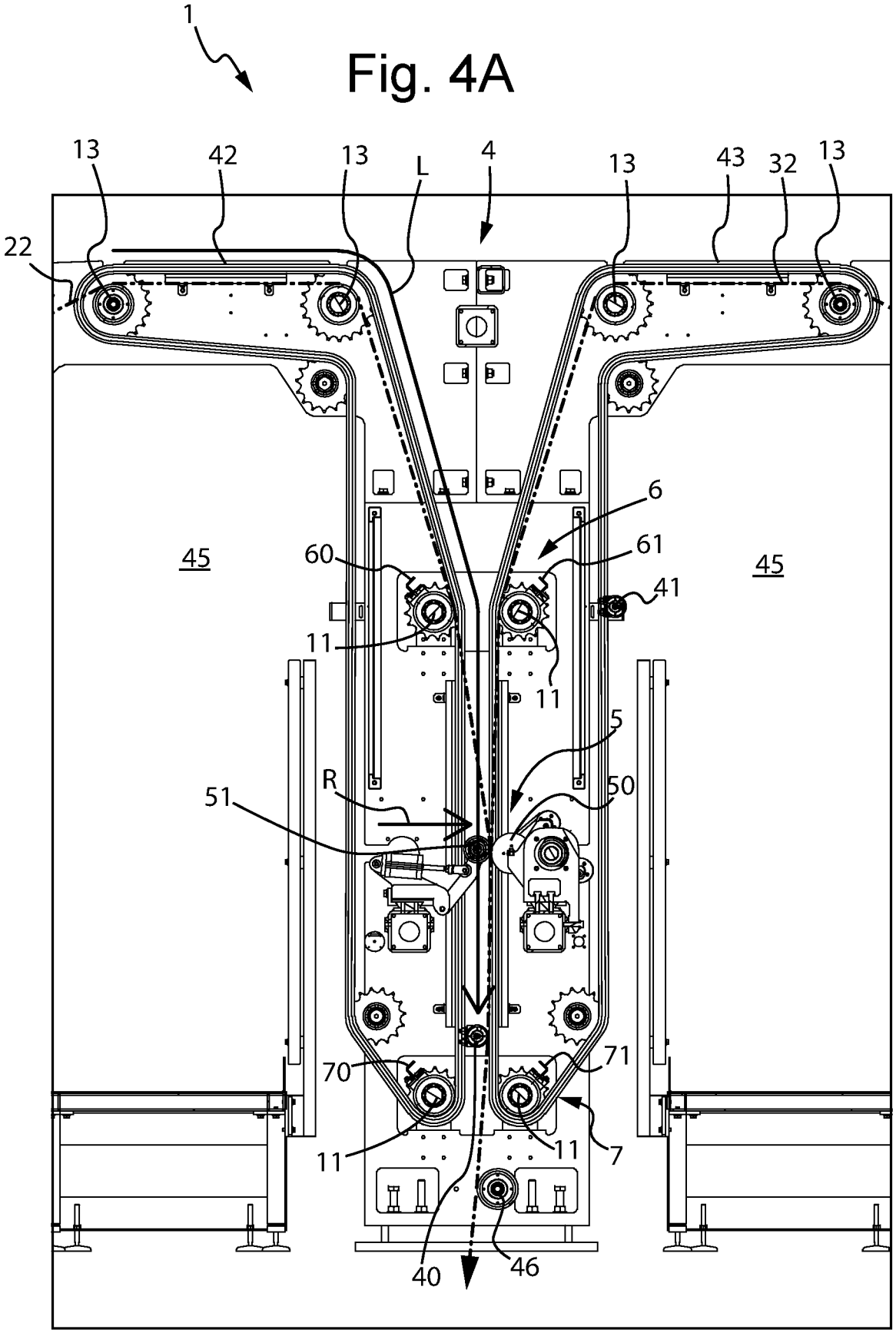

FIGS. 4 and 4A show the step of launching the pulling bar 40. In this step, the pulling bar 40 is pulled by the pulling chain 42 along the joining path at a pulling speed that, in the joining point with the ply 32 of the depleting reel 31, coincides with the unwinding speed of the reel 31 itself.

The movement of the pulling bar 40, during the launching step is indicated with the arrow L.

Once the pulling bar 40 overtakes the joining means 5, said means can be activated to join together the flap of the ply 22 of the new reel 21, pulled by the pulling bar 40, with the ply 32 of the depleting reel 31.

In particular, the counter-roller 51 can be actuated in a transverse direction with respect to the direction of unwinding of the plies 22, 32 to press the flap of the ply 22 and the ply 32 together against the knurling wheel 50.

The movement of the counter-roller 51 is indicated with the arrow R.

In this step, the two plies 22 and 32 are then joined together.

Figure 5:
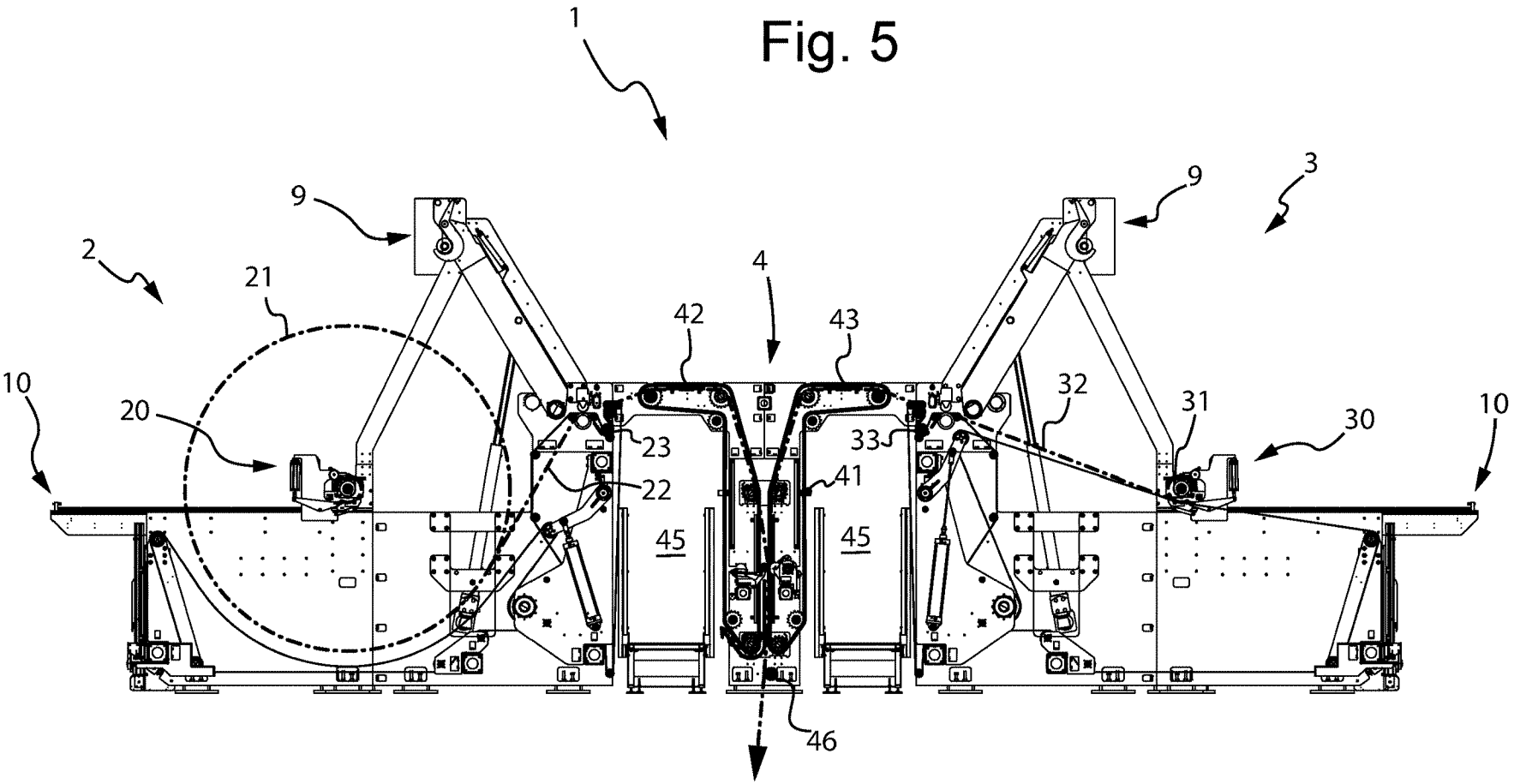
Figure 5A:
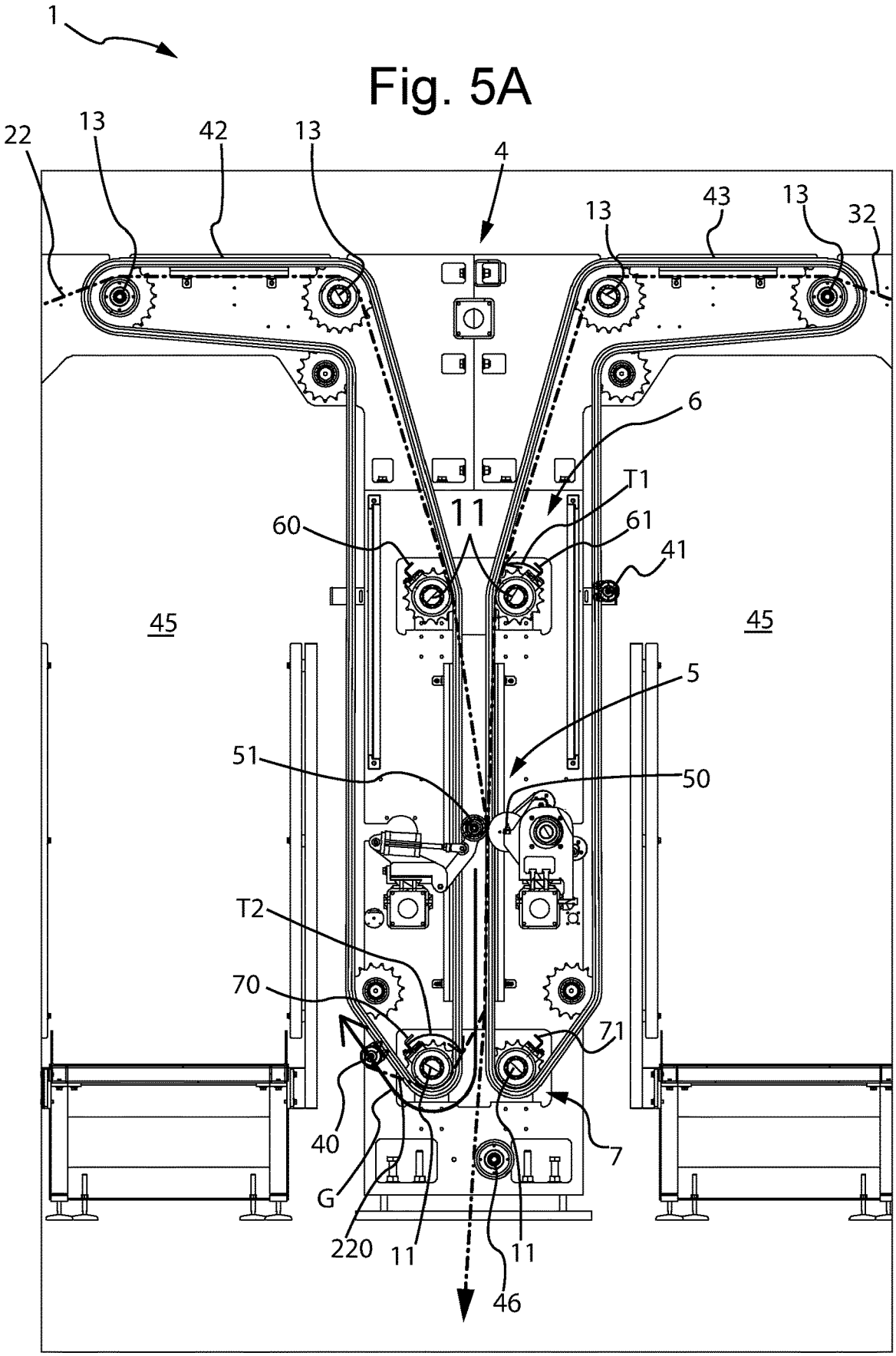

FIGS. 5 and 5A show the step in which the first cutting means 6 intervene to cut the ply 32 of the depleting reel 31, upstream of the joining point. In particular, as shown in FIG. 5A, the blade 61 rotates, as indicated by the arrow T1, to cut the ply 32.

At the same time, the second cutting means 7 intervene to cut the portion 220 of ply 22 of the new reel 21 that has passed beyond the joining point, still attached to the pulling bar 40. In particular, as shown in FIG. 5A, the blade 70 rotates, as indicated by the arrow T2, to cut the ply 32.

The arrow G indicates the movement of the pulling bar 40 in the part of the pulling path that goes from the joining point, at the joining means 5, and beyond the second cutting means 7.

Figure 6:
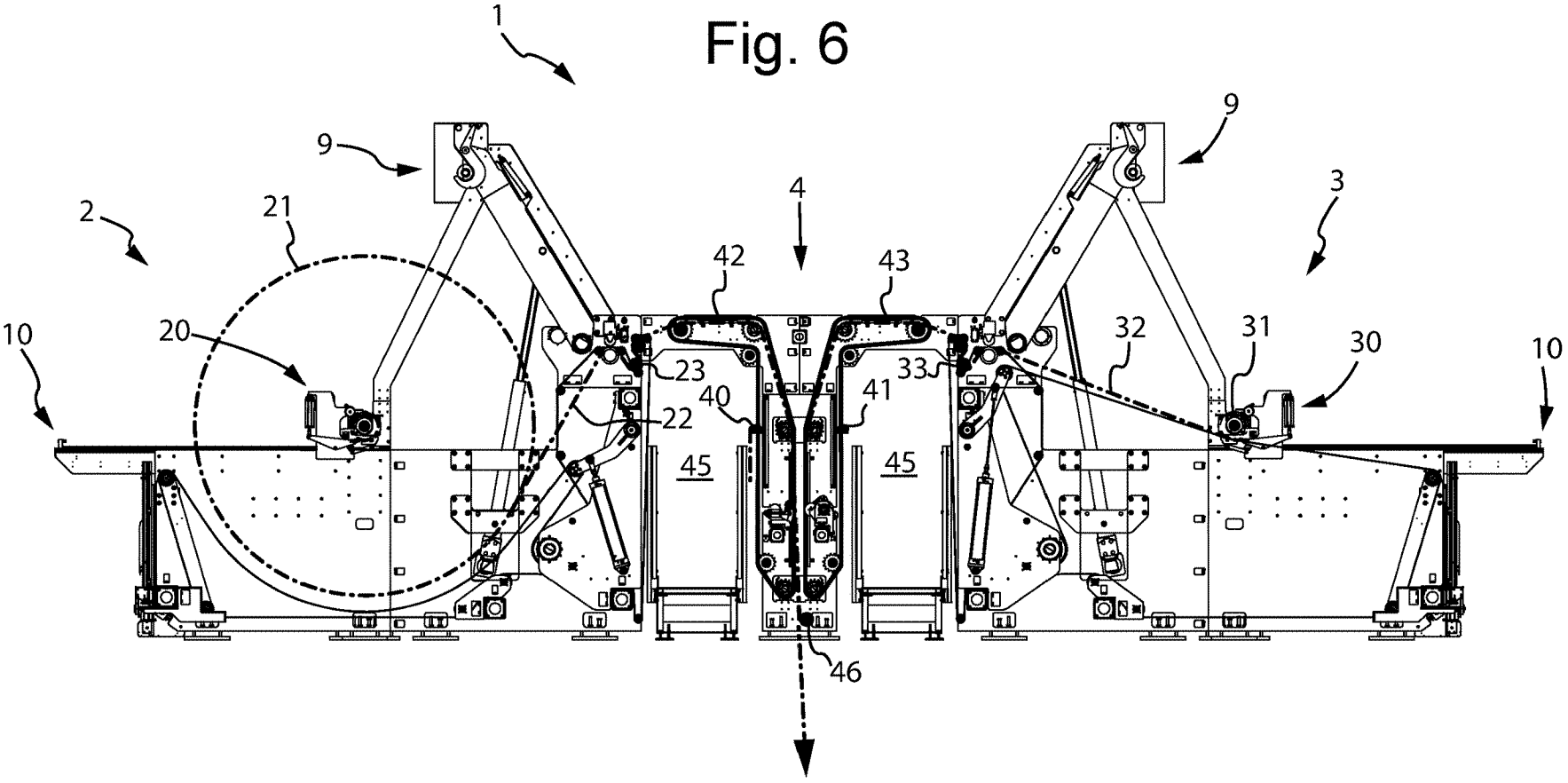
Figure 6A:
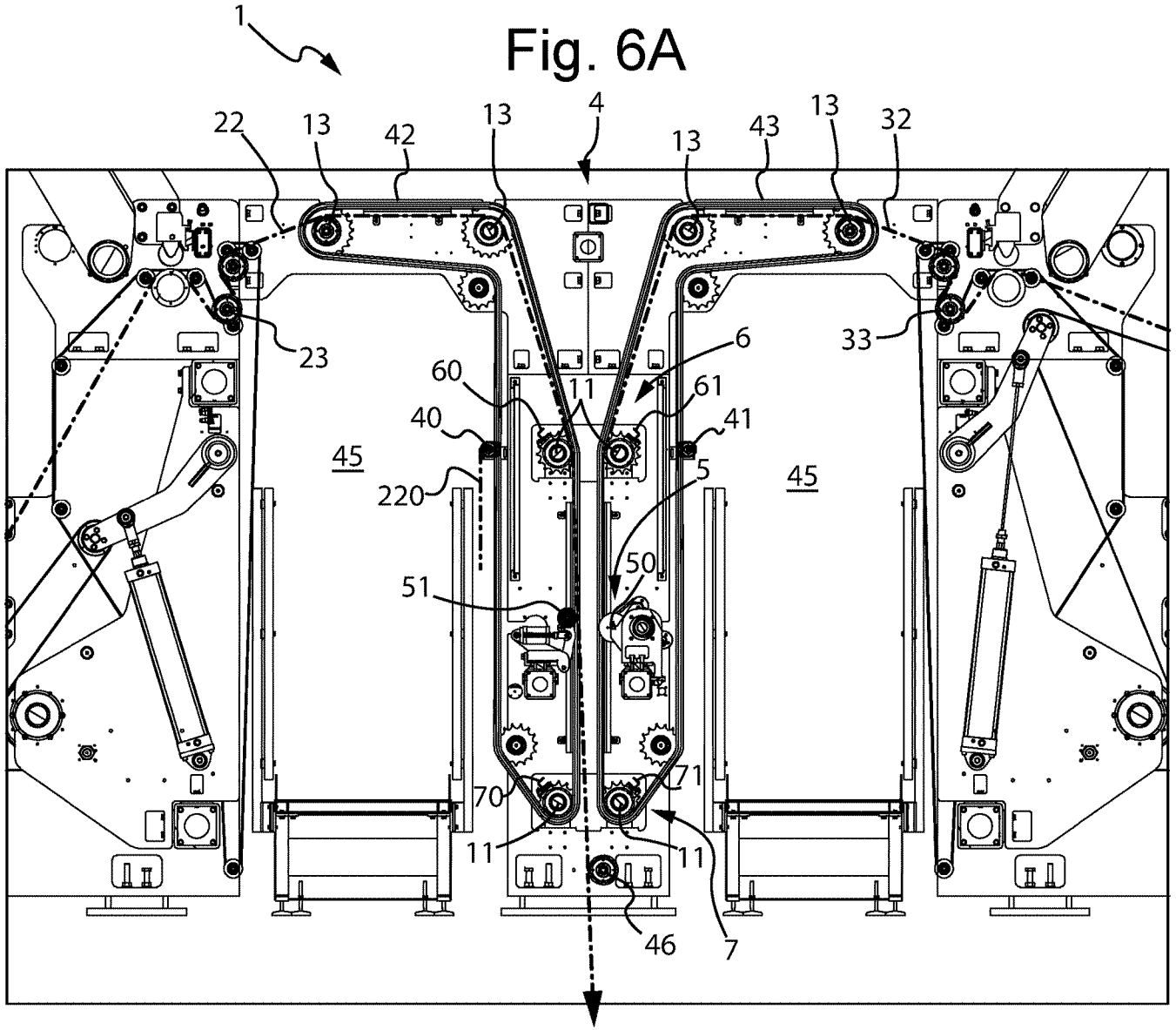
Figure 7:
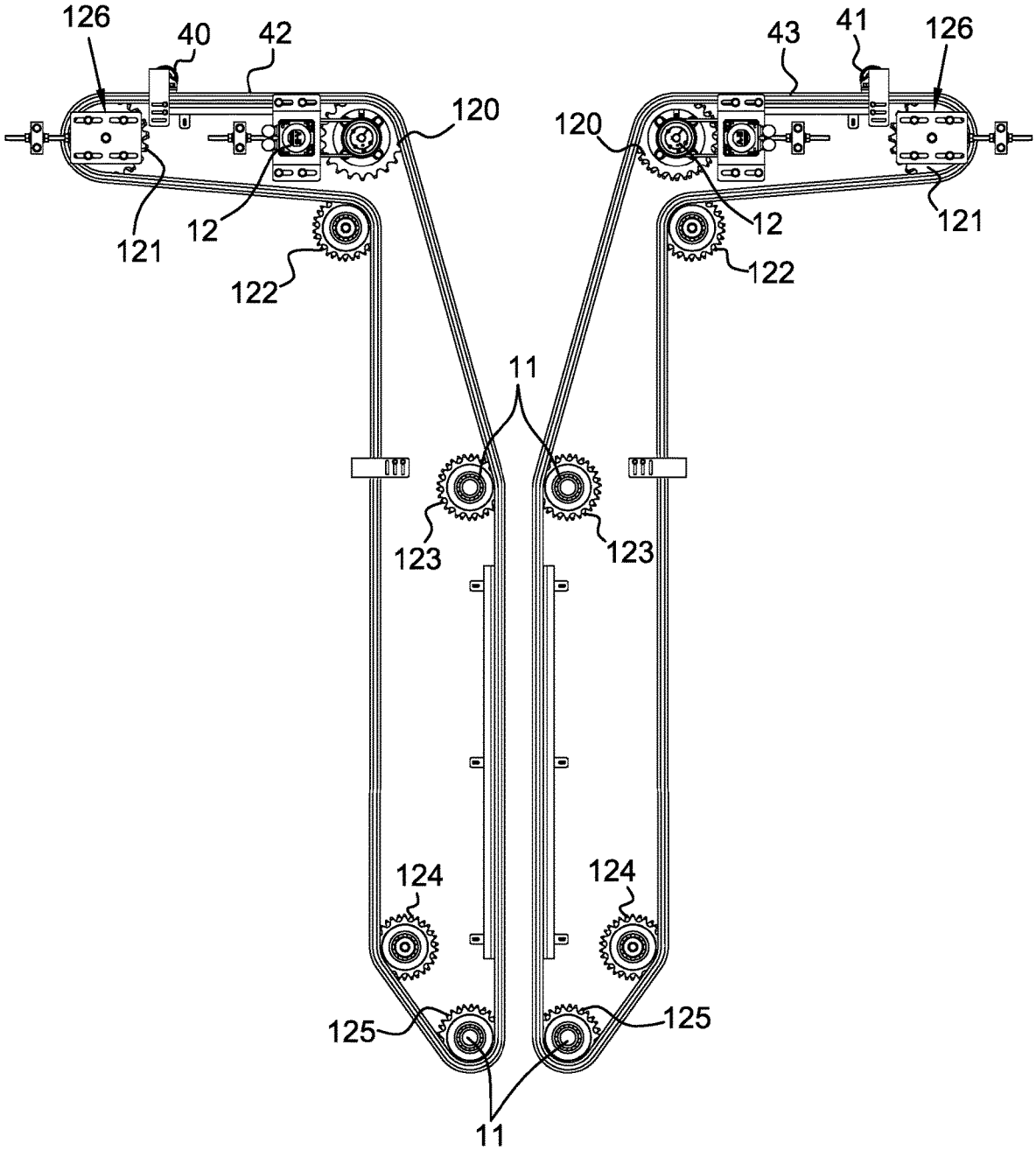
FIG. 7 shows the main components of the joining device with which the apparatus of FIG. 1 is provided.

At this point, as shown in FIGS. 6 and 6A, the unwinding operation continues through the unwinding of the new reel 21, that has taken the place of the old reel 31, while the old reel 31 can be removed from the unwinder 3.

The operator O can also proceed to eliminate the portion 220 of ply 22 still attached to the pulling bar 40.

The junction between reels can be carried out indistinctly between the two unwinders depending on the position of the reel that is being unwound and that has to be replaced. In this way, it is possible to join reels without ever interrupting the feeding of the ribbon to the subsequent steps of processing and transforming the paper.

The figures show the apparatus 1 operating to replace a depleting reel with a new reel. The apparatus 1 can also operate to replace a defective reel, in any point thereof, with a new reel, for example to enable operators to clean up the defective reel without interrupting the unwinding of the paper ribbon.

In practice, it has been observed that the apparatus and the method for unwinding reels and for joining a ply between two reels, according to the present disclosure, perform their task and achieve their purposes, inasmuch as they make it possible to replace depleting reels, or reels with defects, with new reels, without interrupting the feeding of ribbon to the subsequent processing and transformation stations.

Another advantage of the apparatus and of the method, according to the disclosure, is that it is possible to use indistinctly one of the two unwinders present in the apparatus, with the possibility of making in each unwinder also an automatic junction, stationarily, between the reel that is loaded on the arms and the unwinding reel.

An additional advantage of the apparatus and of the method, according to the disclosure, is that it allows the automation of the main steps of joining the plies, reducing the manual interventions of operators.

Yet another advantage of the apparatus and of the method, according to the disclosure, is that each of the two unwinders, taken individually, can also operate independently of the other.

The apparatus and the method thus conceived are susceptible to numerous modifications and variants, all falling within the scope of the inventive concept; moreover, all details can be replaced with technically equivalent elements. In practice, the materials used, as well as their dimensions, can be of any type according to the technical requirements.

The invention claimed is:

1. An apparatus for unwinding reels and for joining a ply between two reels, comprising:

a first unwinder adapted to unwind a first reel;

a second unwinder adapted to unwind a second reel; and a joining device adapted to join a first ply belonging to said first reel with a second ply belonging to said second reel, said joining device comprising a first pulling bar being adapted to pull a flap of said first ply along a joining path with said second ply and a second pulling bar being adapted to pull a flap of said second ply along a joining path with said first ply;

said joining device further comprising joining means configured to join, in a joining point along said joining path, said flap of said first ply with said second ply or said flap of said second ply with said first ply; and said joining device further comprising first cutting means configured to cut said first ply or said second ply upstream of said joining point where the join is performed between said first ply and said second ply and second cutting means configured to cut said flap of said first ply or said flap of said second ply downstream of said joining point.

2. The apparatus, according to claim 1, further comprising an unwinding path of said first reel or of said second reel and a pulling path of said first pulling bar or of said second pulling bar, said unwinding path and said pulling path being arranged facing and parallel to each other along said joining path.

3. The apparatus according to claim 1, wherein in said joining point said first pulling bar is adapted to pull said flap of said first ply along said joining path with said second ply at a pulling speed substantially equal to the unwinding speed of said second ply and in said joining point said second pulling bar is adapted to pull said flap of said second ply along said joining path with said first ply at a pulling speed substantially equal to the unwinding speed of said first ply.

4. The apparatus, according to claim 1, wherein said joining device comprises at least a first pulling chain adapted to pull said first pulling bar at least along said joining path and at least a second pulling chain adapted to pull said second pulling bar at least along said joining path.

5. The apparatus, according to claim 4, wherein said first pulling chain and said second pulling chain define a closed loop.

6. The apparatus, according to claim 4, wherein said first pulling bar and said second pulling bar are associated with said first pulling chain and said second pulling chain, respectively, by means of a free wheel mechanism.

7. The apparatus, according to claim 1, wherein said first unwinder and said second unwinder comprise respectively a first idle return roller for said first ply of said first reel and a second idle return roller for said second ply of said second reel, said first idle return roller and said second idle return roller comprising sensors adapted to detect the tension status of said first ply and of said second ply, respectively.

8. The apparatus, according to claim 1, wherein said first pulling bar and said second pulling bar are rotatable about their own axis in a single rotation direction.

9. The apparatus, according to claim 1, wherein said joining means comprise at least one knurling wheel opposite at least one rigid counter-roller.

10. A method for unwinding reels and for joining a ply between two reels comprising the steps of:

arranging a pair of unwinders configured to unwind a pair of reels;

pulling, at a pulling speed, a flap of a ply of a first reel of said pair of reels along a joining path with a ply of a second reel of said pair of reels;

unwinding, at an unwinding speed, said second reel through an unwinder between said pair of unwinders;

joining said flap of said ply of said first reel with said ply of said second reel in a joining point along said joining path, in said joining point said pulling speed of said ply of said first reel being substantially equal to said unwinding speed of said second reel;

cutting said ply of said second reel upstream of said joining point;

cutting said flap of said ply of said first reel downstream of said joining point;

unwinding said first reel through an opposite unwinder between said pair of unwinders.

11. The method, according to claim 10, further comprising a preparation step wherein said flap of said ply of said first reel is associated with a pulling bar configured to pull said flap at least along said joining path with said ply of said second reel and a launch step wherein said flap is pulled by said pulling bar beyond said joining point at said pulling speed.

12. The method, according to claim 11, wherein between said preparation step and said launch step, a tensioning step of said ply is provided, wherein said ply of said first reel associated with said pulling bar is placed in tension.

* * * * *